US010577893B2

(12) United States Patent
Lau

(10) Patent No.: US 10,577,893 B2
(45) Date of Patent: Mar. 3, 2020

(54) MANUFACTURED GAS WELLPAD EXPANSION APPARATUS AND MODULE

(71) Applicant: Wayne W K Lau, Calgary (CA)

(72) Inventor: Wayne W K Lau, Calgary (CA)

( * ) Notice: Subject to any disclaimer, the term of this patent is extended or adjusted under 35 U.S.C. 154(b) by 185 days.

(21) Appl. No.: 15/669,500

(22) Filed: Aug. 4, 2017

(65) Prior Publication Data

US 2018/0045019 A1 Feb. 15, 2018

(30) Foreign Application Priority Data

Aug. 4, 2016 (CA) ..... 2938252

(51) Int. Cl.
*E21B 41/00* (2006.01)

(52) U.S. Cl.
CPC ..... *E21B 41/00* (2013.01)

(58) Field of Classification Search
CPC ..... E21B 41/00; E21B 34/00; E21B 36/025; E21B 43/12; E21B 43/34
See application file for complete search history.

(56) References Cited

U.S. PATENT DOCUMENTS 3,312,045 A * 4/1967 McCarter ..... E21B 43/34 96/184
3,989,487 A * 11/1976 Peterson ..... B01D 1/00 96/242
8,939,198 B2 * 1/2015 Friesen ..... E21B 43/34 166/75.11
9,416,637 B2 * 8/2016 Allouche ..... E21B 21/106

FOREIGN PATENT DOCUMENTS

CA 2503450 A1 * 10/2006 ..... E21B 43/34

* cited by examiner

*Primary Examiner* — Matthew R Buck
(74) *Attorney, Agent, or Firm* — Porter, Wright, Morris & Arthur, LLP

(57) ABSTRACT

A modularized gas wellpad apparatus and an expansion module, that is repeatable on a per-well or multi-wells basis and can be pre-manufactured. Tie-in points may be limited to a junction box and group and test headers only. The apparatus comprises gas handling components located close to the wellhead, and a heated, standalone enclosure for housing environmentally sensitive components. Various embodiments provide for a compact wellpad apparatus having a particular layout. Various embodiments include a built-in capability to mate-up to wellhead as-built locations and dimension deviations without field rework, even for multiple-wells modules.

3 Claims, 5 Drawing Sheets

MANUFACTURED GAS WELLPAD EXPANSION APPARATUS AND MODULE

CROSS-REFERENCE TO RELATED APPLICATIONS

The present application claims priority from Canadian Patent Application No. 2,938,252, filed on 4 Aug. 2016 and incorporated herein by reference in its entirety.

FIELD OF THE INVENTION

The present invention pertains to the field of natural gas extraction equipment and in particular to gas wellpad expansion systems for use in expanding a gas well.

BACKGROUND

Gas production assets owners typically have long range development plans to expand each of their gas wellpads incrementally, either for replacement of depleting production and/or for growth of production targets. Regardless of the differences of gas wellpad expansion strategy between asset owners, each owner will have similar long-term expansion strategy for each asset location. Due to original wellpad planning, fiscal financial governance, operations learnings and other owner-specific requirements, each owner's gas wellpad expansion approach typically evolve little in project charter, engineering scope and construction activities. A four-well gas pad expansion is common for many owners, and is considered a relatively small project scope.

The prevailing industry engineering and construction strategy for gas wellpad expansion has been largely to perform all-field fabrication and construction. This is often executed with multiple construction crew mobilizations. The field construction approach is taken largely due to the perception that it is more cost effective to field as-built/design and construct the surface facilities.

The multiple crew mobilizations are generally driven by an owner's desire for earliest start of flowback production between drilling completions of each well. Because historical Pad-On-Production (POP) metrics, for typical 4-wells surface facilities pad expansion full construction, can range up to about 35 days, many owners will opt to mobilize multiple times between completions with perception that flowback production will offset additional construction mobilization cost. Multiple construction mobilization can increase crew exposure to simultaneous-operations (simops) safety risks.

Therefore, there is a need for a gas wellpad expansion system that is not subject to one or more limitations of the prior art.

This background information is provided to reveal information believed by the applicant to be of possible relevance to the present invention. No admission is necessarily intended, nor should be construed, that any of the preceding information constitutes prior art against the present invention.

SUMMARY

An object of embodiments of the present invention is to provide a gas wellpad apparatus. The apparatus is fluidically coupled between a wellhead and output piping. The output piping may convey gas from more than one wellhead. The apparatus may be used in a gas wellpad expansion. The apparatus is manufactured or prefabricated (e.g. in a manufacturing facility or shop), prior to delivery to the well site, as a generic (e.g. standardized) and adjustable modular assembly. The apparatus includes gas handling components such as but not limited to one or more of: a shutoff valve; blast tees; a group header, a test header, a choke valve; and a metering component. The apparatus also includes an input connection for joining the apparatus to a gas wellhead to receive pressurized gas. The apparatus also includes a heated, standalone enclosure comprising at least one of the gas handling components. The apparatus also includes an output connection for joining the apparatus to the output piping.

The apparatus can include closely-coupled components arranged in a particular manner to provide for compactness. The apparatus can further include adjustable components, such as adjustable input and output connections, to facilitate joining of the apparatus to the wellhead and the output piping. The apparatus can further be adjustable to include or exclude certain optional gas handling components.

Embodiments of the present invention provide a modularized gas wellpad expansion system, wherein modules comprising one or more well pad expansion apparatus (also referred to as core lay out assemblies) are repeatable on a per-well or multi-wells basis and can be pre-manufactured. Tie-in points for the module(s) can consist of a junction box and group and test headers only. Some embodiments facilitate up to a 50 percent reduction in plot space and a reduction in material costs relative to the prevailing industry design norms. Various embodiments can lead to reduced total-installed-cost, and reduced field construction durations. Pre-manufacturing of the wellpad expansion module can lead to significant amount of construction effort being redirected from field to shop, with a corresponding reduction in overall safety risks, while meeting owners sanctioned process designs, best practices and majority owner-required special design features.

Embodiments of the present invention also provide a module which is capable of adjustment in order to align to out-of-spec, as-built locations and orientations of wellhead highline connections on a multiple wellhead expansion system. This can be done using a combination of piping/equipment layout and strategic-technical-placement of adjustment provisions.

In accordance with embodiments of the present invention, there is provided a wellpad apparatus (core lay out assembly) for use in a module for a gas wellpad expansion system. The apparatus can be manufactured as a generic, adjustable modular assembly and comprises: an input connection for joining the apparatus to a gas wellhead to receive pressurized gas therefrom; one or more gas handling components fluidically coupled to the input connection; a heated, standalone enclosure comprising at least one of the one or more gas handling components; and an output connection fluidically coupled to the one or more components, the output connection for joining the wellpad apparatus to output piping. The wellpad apparatus is also capable of adjustment in order to align to out-of-spec, as-built locations and orientations of wellhead highline connections on a multiple wellhead expansion module. This can be done using a combination of piping/equipment layout and strategic-technical-placement of adjustment provisions.

In accordance with embodiments of the present invention, there is provided a wellpad apparatus for use in a gas wellpad expansion module, the apparatus manufactured as a generic, adjustable modular assembly and comprises: an input connection for joining the apparatus to a gas wellhead to receive pressurized gas therefrom; an emergency shutdown valve aligned with the input connection and having a channel oriented in a first horizontal direction; a first horizontally oriented blast tee having a horizontal input arm aligned with the channel of the emergency shutdown valve and having a horizontal output arm oriented in a second horizontal direction that is perpendicular to the first horizontal direction; a second horizontally oriented blast tee having a second horizontal input arm aligned with the output arm of the first blast tee and having a second horizontal output arm oriented horizontally and opposite to the first horizontal direction; a choke valve having a horizontal input pipe coupled to the second horizontal output arm of the second blast tee, the choke valve further having a first vertical piping coupled to an output of the choke valve; a coupling section having a vertical input connected to the output of the choke valve and a horizontal output oriented horizontally and opposite to the first horizontal direction; a metering component in a heated enclosure, the metering section connected in line with the horizontal output of the coupling section; and an output connection fluidically coupled to the metering component, the output connection for joining the wellpad apparatus to output piping.

According to an embodiment of the present invention, there is provided a manufactured gas wellpad expansion module as illustrated in FIGS. 1 and 2 for a well pas expansion system. The wellpad expansion module comprises: at least one wellpad apparatus (core layout assembly) as illustrated in FIGS. 3A and 3B; at least one operating access level grating surface; at least one directional anchor assembly coupled to an Emergency Shutdown Valve (ESD) valve of the apparatus; a set of group and test headers and layout zone as illustrated in FIGS. 1 and 2; an Electrical and Instrumentation (E&I), Pneumatic and Utilities Conduits and layout zone as illustrated in FIGS. 1 and 2; a junction box for overall module E&I tie-ins; and a structural base skid. The base skid may be configured with sufficient structural integrity for supporting, transporting and final site installation of all on-module piping, equipment, all E&I, pneumatics and utilities connections conduits and bulks, all access appurtenances, and all other required materials for commissioning of module. Example modules include one, two or four separate core-layout assemblies.

According to an embodiment of the present invention, there is provided a core layout assembly in a manufactured gas wellpad expansion module, as illustrated in FIGS. 3A and 3B. The core layout assembly has modular components comprising: a heated enclosure housing metering components; a highline flanged spool intended to connect from wellhead highline connection to ESD without any directional changes; an Emergency Shutdown Valve (ESD) located inline with the highline flanged spool and a blast tee for sand separator connection; a pair of blast tees for sand separator supply and return connections (each tee having pup pieces depicted in FIG. 3B); a choke valve discharging production gas flow to the metering zone inside the heated enclosure; a High Integrity Flanged Rotatable connection; and a valved group and test connections pair exiting from the metering downstream run, into the group and test headers. Some or all of the components may be optional. For example, the ESD valve may be located away from the core layout assembly.

According to an embodiment of the present invention, there is provided a wellpad apparatus/core layout assembly in a manufactured gas wellpad expansion module, as illustrated in FIGS. 3A and 3B, the core layout assembly having modular components for facilitating alignment adjustments to an as-built wellhead position, the core layout assembly comprising: a pair of blast tees for sand separator supply and return connections (each tee having pup pieces as illustrated in FIG. 3B); and a High Integrity Flanged Rotatable connection.

The core layout assembly/apparatus of the present invention has fitting-to-fitting components and closed-coupled equipment layout.

In various embodiments, the wellpad apparatus/core layout assembly of the present invention has fitting-to-fitting components and/or closed-coupled equipment layout. The arrangement of the fitting-to-fitting components and closed-coupled equipment provides a natural flexibility, which allows the overall piping arrangement to function within sustained-process, gravity and thermal sources of piping stresses. Moreover, this arrangement may enable the rotatable fitting and the blast tees' pup pieces options to adjust to limited highline misalignment, that are normally within construction tolerance. This arrangement would normally not be done, or may even be purposefully avoided in standard shop and design practice. In some embodiments, the rotatable fitting may be omitted, for example if the owner accepts a design and construction procedure that enables field-verified alignment information for shop fabrication. That is, when the apparatus is customized to field-verified dimensions, adjustable portions such as the rotatable fitting may be omitted.

In various embodiments, when locating the ESD valve(s) onto the module, dynamic stress forces are induced onto the flexible core-layout during emergencies. These dynamic stresses would impact the sand separators as well, when they are connected in temporary use. Therefore, an anchor may be provided to allow the apparatus/core-layout assembly and/or well expansion module comprising one or a plurality of apparatus/core layout assemblies, to function with sufficient flexibility, while mitigating the directional (i.e. in the direction of process flow) dynamic stresses.

BRIEF DESCRIPTION OF THE FIGURES

Further features and advantages of the present invention will become apparent from the following detailed description, taken in combination with the appended drawings, in which.

It will be noted that throughout the appended drawings, like features are identified by like reference numerals.

DETAILED DESCRIPTION

Figure 1:
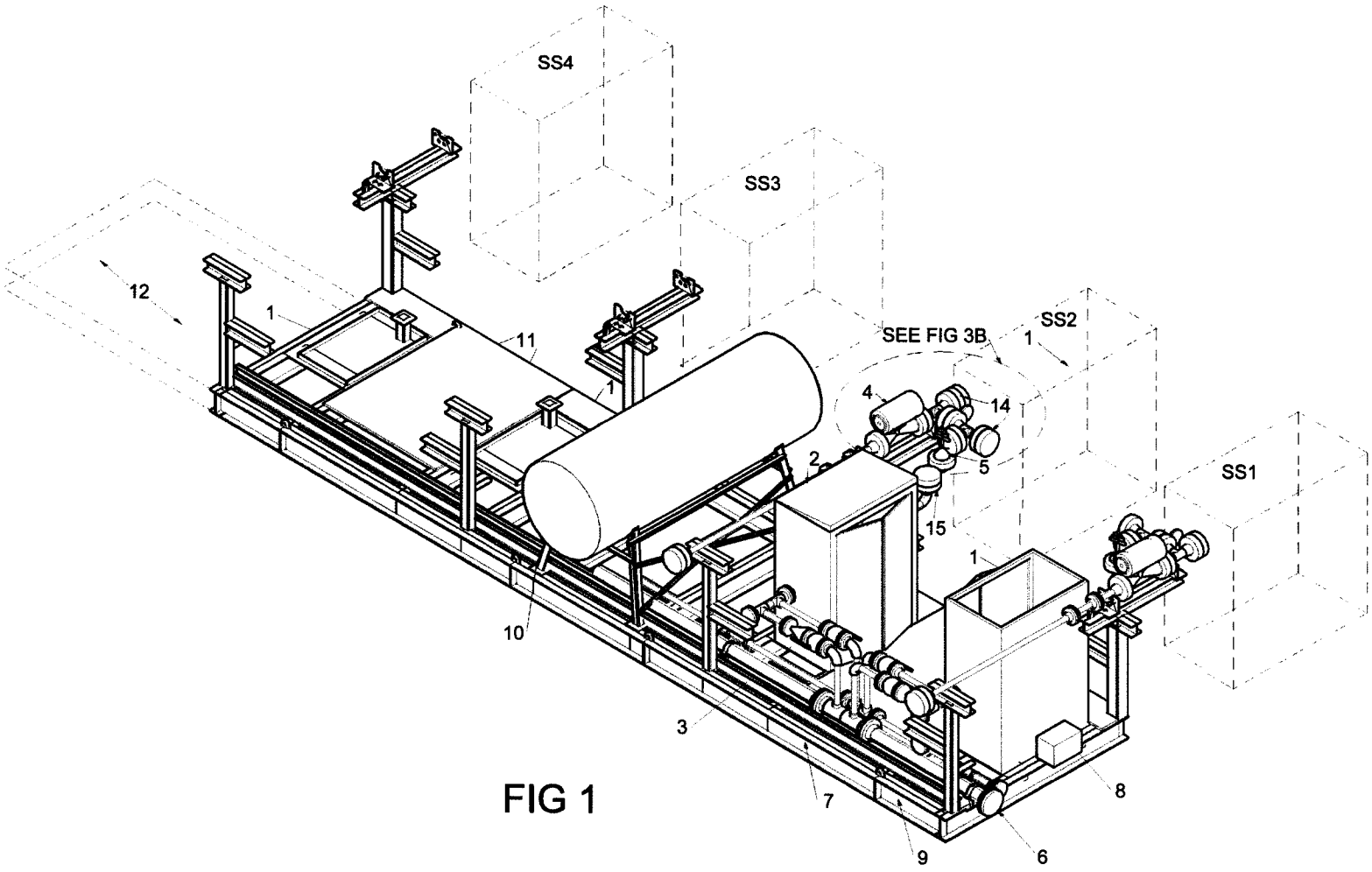
FIG. 1 illustrates a four-well wellpad expansion module, according to an embodiment of the present invention.

Embodiments of the present invention provide a wellpad apparatus (also referred to as core layout assembly) for use in a gas wellpad expansion module for a gas well pad expansion system. The apparatus is manufactured (prefabricated/prior to well site delivery) as a generic, adjustable modular assembly. A wellpad expansion module comprising one or more such wellpad apparatuses is also provided. The apparatus as disclosed herein can be used as an initial stage wellpad infrastructure as well as for subsequent expansions.

Contrary to the general understanding in the relevant field, it has been recognized by the inventor that gas wellpad expansion systems can be effectively standardized and modularized. The industry has mostly not moved in this direction for smaller wellpad projects, due to the understanding that modularization of wellpad facilities may risk many field-fit issues to wellhead and may increase field work costs.

Embodiments of the present invention facilitate the modularization of smaller wellpad facilities by addressing field-fit issues related to fitting wellpad equipment to the wellhead. This approach can mitigate the potential for field rework costs, which were previously avoided by following the all-field fabrication approach. Embodiments of the present invention provide for high adjustability for fitting to wellhead as-built highline connections (as-built Northing, Easting, elevation and angular positions).

Embodiments of the present invention potentially achieve a nominal 12 days construction duration, for most 4-wells surface facilities pad expansion (this duration must be verified per exact issued-for-construction (IFC) scope). This allows owners the option to have a singular construction mobilization, thus further reducing costs and safety risks.

Furthermore, embodiments of the present invention may readily and effectively adapt to owner-specific gas wellpad designs and result in a standardized wellpad expansion module.

Embodiments of the present invention provide for a manufactured module approach to gas wellpad expansion, which can potentially lead to expansion module standardization. The module layout in some embodiments is able to adapt to various gas reservoir's final wellhead discharge pressure, and is inherently able to accommodate additions or reductions of equipment for key gas production variations, such as dry versus condensation rich gas streams. Embodiments of the present invention can be used for gas production wells which already have adopted downhole chokes. Embodiments of the present invention can be used for example for well spacings of 4 to 6 meters. Larger well spacings can also be accommodated.

Prior gas wellpad expansion systems generally have a heated building for functions of metering and production manifold switching between wells of the expansion, along with a neighboring methanol storage for inline injection into piping housed in the building. Embodiments of the present invention mitigate or eliminate the need for the heated building, thus reducing the required footprint of the gas wellpad expansion system. The equipment that would have been located in the heated building is instead located close to the wellheads (e.g. as close as possible) and in a heated enclosure of limited size. Since high pressure critical equipment is typically required to be located close to wellhead, grouping all equipment together and close to wellhead, while meeting regulatory requirements, can yield a gas wellpad expansion module and system exhibiting a particularly small plot space using limited material quantities, such as limited or minimal piping runs. The modules (up to 4 wells) can be trucked within a single pilot car category per regional transportation guidelines.

The configuration and location of a gas wellpad expansion module according to some embodiments of the present invention enables grouping of all key systems of the surface gas pad expansion onto a single structural skid. This allow for a turn-key shop-built module, in which interphase points can be reduced to a Junction Box (JB) and group and test production line connections.

Figure 3A:
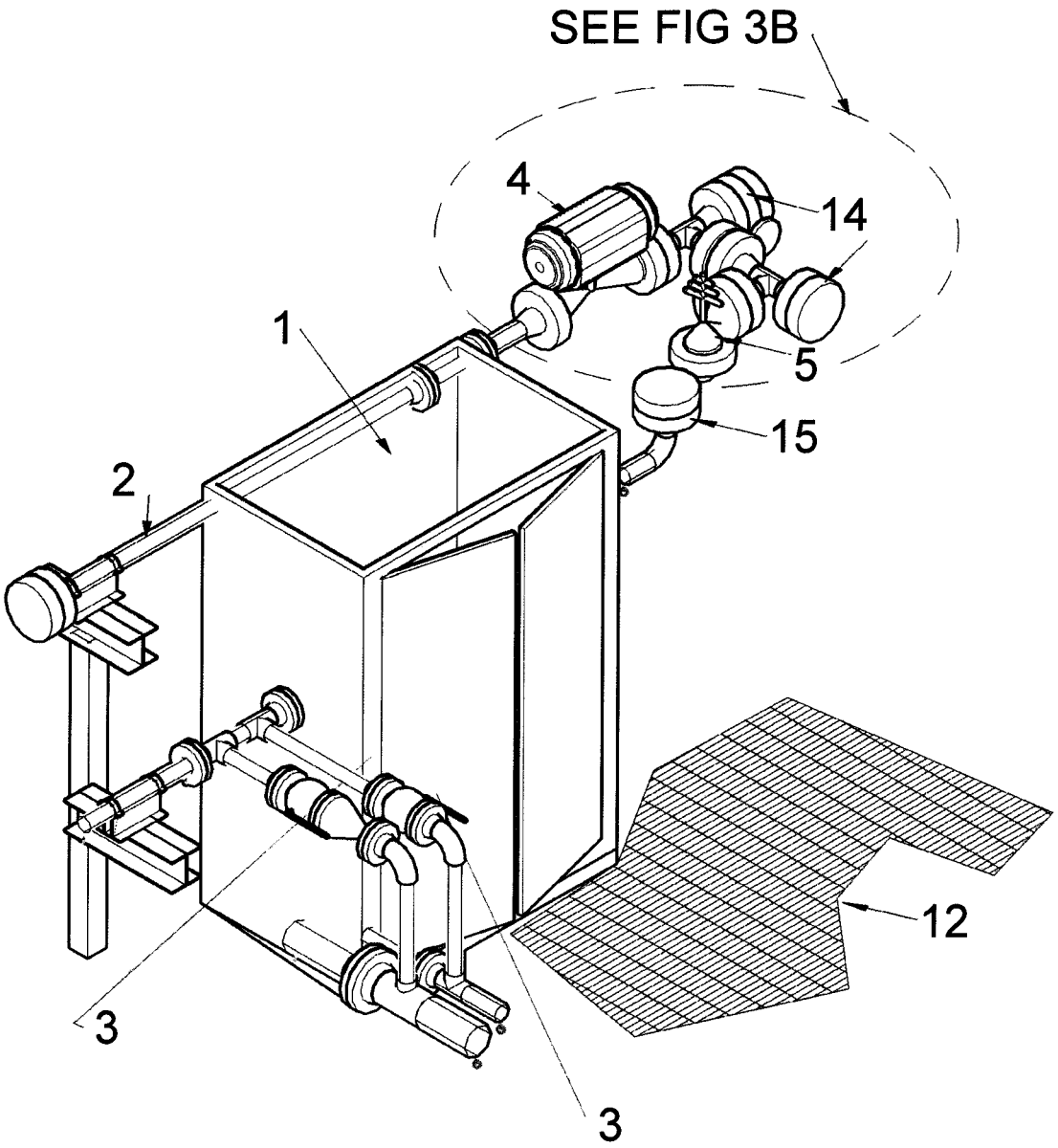
FIG. 3A illustrates the wellpad apparatus/core layout assembly, for a single wellhead, for a wellpad expansion module, according to an embodiment of the present invention.
Figure 3B:
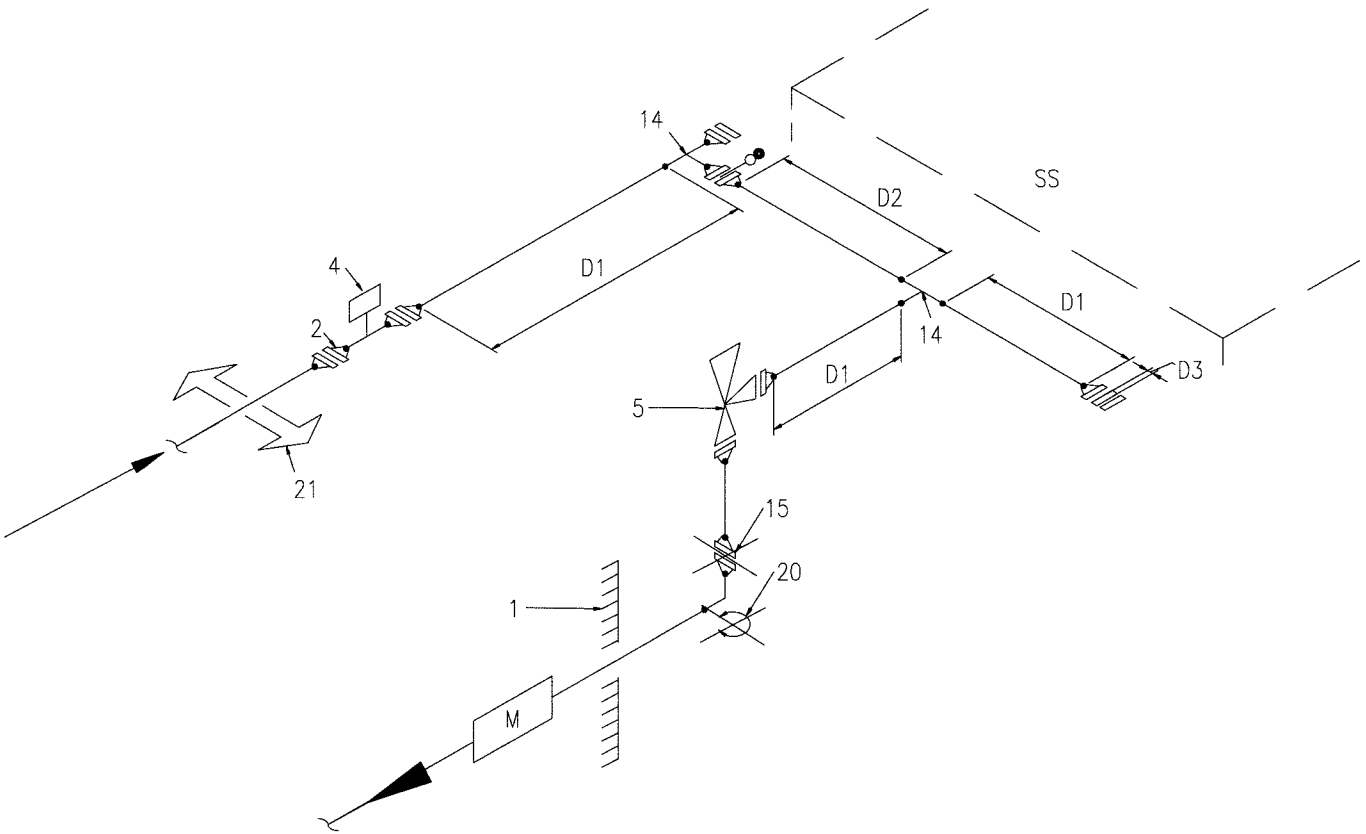
FIG. 3B schematically illustrates the core layout assembly of FIG. 3A, according to an embodiment of the present invention.

For each wellhead, embodiments of the present invention can have a compact wellpad apparatus/core-layout assembly depicted in FIGS. 3A and 3B. This compact core layout assembly may have some or all of the key equipments necessary for major functionality of each well. Hence, this core-layout assembly along with an operating level (as depicted in all figures) would form a repeatable scope basis for a minimum scope (single well) manufactured module. The core-layout assembly may also be the foundation of a two-well and the four-well manufactured module, as well as repeating multiples of modules. The module may comprise multiple identical or similar copies of the core-layout assembly.

The core-layout assembly, as depicted in FIGS. 3A and 3B, may exhibit a "zero directional changes" property of the wellhead production before connection to other components (such as but not limited to emergency shutdown (ESD) valve or sand separation components), while maintaining a compact core layout. The zero directional change feature can improve longevity of the highline, while adhering to regulatory requirements in certain local regulatory authorities.

In more detail, the "zero directional changes" property provides that the input to the wellpad expansion apparatus is aligned with the highline piping exiting the gas well to be coupled thereto, so that the highline can be mated directly to the wellpad expansion apparatus without requiring bends or turns in the pipe. Alternatively, a limited number of directional changes can be accommodated.

The core-layout assembly, as depicted in FIGS. 3A and 3B, comprises blast tees immediately downstream of the ESD valve (for embodiments in which the ESD valve is included in the core-layout). This layout may facilitate an unobstructed laydown area for portable sand separators, or portable test separation modules, or both, the types being of the owner's final selection. This layout is also expected to impose limited impedance on future service rig access or laydown. In some embodiments, one or more of the sand separators may be located on the opposite side of the core-layout assembly as the wellheads. In other embodiments, one or more of the sand separators may be located on the same side of the core-layout assembly as the wellheads.

The core-layout assembly, as depicted in FIG. 3A, can exhibit various operability, maintainability and accessibility properties, which often are overlooked in a highly condensed modularization design. These concerns may be addressed in a safety-standards compliant yet cost practical manner.

In some embodiments, the core-layout assembly (FIG. 3A), regardless of the number of wells of the overall assemblies or modules, affords on-foot accessibility to all sides of the core-layout assembly and to every operational point. Also, all or nearly all maintenance points may be accessible on-foot in some embodiments.

In some embodiments, operations personnel are afforded large operating access levels (item 11 depicted in the Figures), which are only two steps or two ladder rungs from grade for typical wellhead construction.

Operational access points are those points accessed by operators on regular basis, and should be readily accessible, e.g. without special equipment. This accessibility should also meet appropriate safety (e.g. occupational health and safety administration (OSHA)) standards, which address ergonomic issues and human factors for layouts and designs in general. Embodiments of the present invention can be configured to meet or exceed all OSHA standards for operability access.

Maintainability access points are those points normally accessed by maintenance crew during planned maintenance. During unplanned maintenance, systems are often shut down and portable access equipment is required. Embodiments of the present invention can provide an adequate number of maintenance points accessible on-foot from either grade or operating access level.

In some embodiments, maintenance points not accessible on-foot can be accessed using heavy lifting equipment. Hence, either a man-basket or a combination of picker and 8-foot step ladder (from grade) may be used to reach such maintenance points. Optional access platforms can be incorporated into embodiments of the present invention. Other embodiments may omit such platforms but offer a lowest-cost technically-acceptable solution, while meeting all applicable industry best practices and Occupational Health and Safety Act (OHSA) human factors standards.

Embodiments of the present invention, for example as depicted in FIG. 3A, can exhibit a tight (e.g. tightest possible) possible piping layout while providing limited or minimal technically-acceptable piping flexibility. For example, the minimum amount of piping between components can be achieved by locating all components close together, so that the output of each component (except the last component) is located as close as possible to the input of the component immediately downstream therefrom.

Embodiments of the present invention can provide for a core-layout assembly that is highly efficient with respect to one or more of the follow aspects: utilizing a smallest possible plot space; minimizing turns, fittings, welds and hence minimal costs; as well as meeting stress-analysis requirements.

In various embodiments, it is recognized that there may be a moderate risk of ESD valve dynamic loads on this highly compact and mostly straight-runs layout. Therefore, in some embodiments (in most cases where the ESD valve is not directly connected to wellhead but is instead integrated into the core layout assembly), an inline anchor is provided to mitigate possible dynamic loads from the ESD valve. This anchor can be implemented without need for direct steel support, thus allowing for unobstructed access for maintenance of ESD valve and hook-up of portable sand separator to blast tees. This anchor is designed appropriately with inline gaps and lateral movements, working in combination with the overall flexible arrangement of fitting-to-fitting piping and closed-coupled equipment layout as described elsewhere herein. This configuration may provide for a limited (e.g. tightest possible) plot space having limited (e.g. minimum) material usage. The anchor can be a directional anchor (anchor assembly) which is attached to the undersides of the ESD valve 4 and the highline connection pipe 2 (as illustrated in FIGS. 3A and 3B). An example of such a directional anchor is described with respect to FIG. 4.

It is noted that layouts comprising fitting-to-fitting coupling and/or closed-coupled equipment is typically not performed by conventional shops, because of difficulties involved (e.g. due to limited flexibility) and dynamic load issues. However, embodiments of the present invention potentially overcome these difficulties and allow a viable core layout assembly comprising fitting-to-fitting coupling and/or closed-coupled equipment.

The core-layout assembly, as depicted in FIGS. 3A and 3B, can exhibit strategically placed piping directional changes in particular planes of orientation. As such, special fittings and planned adjustment procedures can be shop-performed for precise field mate-up the highline to the wellheads' as-built locations (final Northing, Easting and Elevations) and orientations.

It is a common concern for owners that if an innovative modularized design is adapted for cost reduction reasons, sanctioned process basis, company specifications and learnings of multiple disciplines may need to be abandoned. To address this, embodiments of the present invention are intended to generally retain all key owners' internal standards and requirements. For example, some or all of the following can be potentially realized in some embodiments: cost reductions, truncated field construction duration and high operability by innovative layout designs, supported by fit-for-purpose strategic engineering improvements.

Embodiments of the present invention are configured to suit wellhead spacing of 4 to 6 meters. However, other embodiments can be configured to suit other wellhead spacings. Moreover, a single-well module can be used to accommodate a wide variety of well spacings.

FIG. 1 illustrates a well pas expansion system comprising a four-well wellpad expansion module, according to an embodiment of the present invention. Two of the four pads of the wellpad expansion module are populated with two out of a possible four gas wellpad apparatuses (core-layout assemblies) in the illustration. In other embodiments, each gas wellpad apparatus (serving a single well) can be provided independently. In other embodiments, an N-well wellpad expansion module can be provided, with N>1. Referring now to the illustrated embodiment, up to four sand separators SS1, SS2, SS3 and SS4 may be located as illustrated and operatively coupled to each respective gas wellpad apparatus. The expansion module is configured to hold up to four gas wellpad apparatuses arranged collinearly (although other spatial arrangements can be accommodated). Each wellpad apparatus is characterized by the presence of a heated enclosure 1 or footprint for an unpopulated heated enclosure 1, along with associated gas handling components, where applicable. Each heated enclosure can include metering components and/or other components of the wellpad apparatus.

In general, the wellpad expansion module includes structural and operational components for holding and operating one or more wellpad apparatuses housed thereon. The structural components can include a structural base, pads for accommodating the wellpad apparatuses, support structures, conduits, anchors, etc. The operational components can include piping, piping connectors, tanks, electrical connectors, cables, hydraulic or pneumatic lines and/or connectors, etc.

A highline connection pipe 2 between a wellhead and a wellpad apparatus of the wellpad expansion module is also shown. The highline connection pipe may be aligned with a mating highline output piping of the wellhead and coupled thereto at a connection point, such as a flanged piping connector.

Gas output of each wellpad apparatus of the wellpad expansion module is provided to common pipes via group and test header connections 3. The group header connections couple gas output to a common bulk gas pipe, while the test header connections couple gas output to one of one or more test pipes. The pipes can collect gas output from all or a selected subset of the component of the wellpad apparatuses.

Also illustrated in FIG. 1 are the ESD valve 4 of a wellpad apparatus and the choke valve 5 of the wellpad apparatus. These components will be described in more detail elsewhere herein.

Group and test headers 6 are illustrated for providing aggregated gas output of the wellpad expansion module, as received from the wellpad apparatuses thereof. Bulk gas output from each of the wellpad apparatuses are input, via the group and test header connections 3, into a common bulk gas pipe which terminates at the group and test headers 6. The group header can include a connection for fluidically connecting this common bulk gas pipe to a mating section of output piping. Gas output from selectable ones of the wellpad apparatuses can also be selectably routed, via the group and test header connections 3 (by operation of appropriate valves) to one or more test pipes which terminate at the test header(s). The test header(s) can include connection(s) for fluidically connecting the test pipe(s) to mating section(s) of output piping. The group header can provide a production output for the gas, while the test headers can provide testing outputs for the gas.

An Electrical and Instrumentation Controls (E&I) and pneumatics tray and conduits zone 7 is also shown. This is an elongated area running to each wellpad apparatus, within which electrical cables, pneumatic or hydraulic lines, or the like, can be routed as necessary. Conduits or other enclosures may be used to protect the routed cables or lines.

The wellpad expansion module includes a junction box 8. The junction box may include electrical connectors for coupling components of the wellpad expansion module to a source of power and optionally to additional cables for carrying monitoring and control signals.

In some embodiments, the wellpad expansion module is provided on a structural steel skid-base, having a boundary 9 as illustrated. The base may include structural components and connection points for affixing and accommodating the wellpad apparatuses.

The wellpad expansion module may include a methanol storage tank and utility zone 10, for example located between a first pair of wellpad apparatus locations and a second pair of wellpad apparatus locations. The methanol storage tank may be coupled to the group and/or test header piping, e.g. via one or more controllable valves, to facilitate inline injection of gas stored in the tank into gas output from the wells. The wellpad expansion module includes an operating access level 11, which may comprise a concrete pad or grating floor, for example. The wellpad expansion module includes an optional equipment level 12, which may also comprise a concrete pad or grating floor, for example and may be used for housing additional stationary or mobile equipment.

Figure 2:
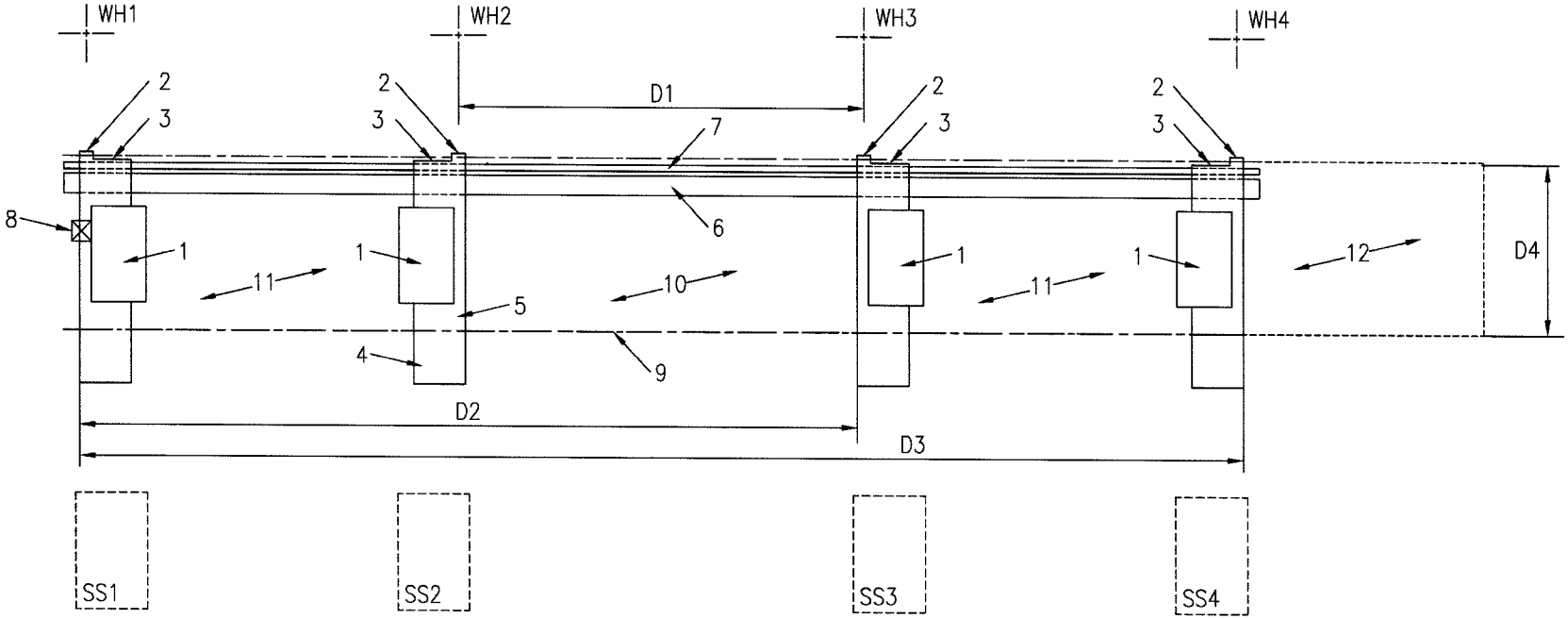
FIG. 2 illustrates a plan view of the wellpad expansion module of FIG. 1, according to an embodiment of the present invention.

FIG. 2 is a plan view of a wellpad expansion system comprising the wellpad expansion module illustrated in FIG. 1. In addition to the components described above with respect to FIG. 1, FIG. 2 illustrates the location of four wellheads WH1, WH2, WH3 and WH4 which are aligned with the four respective wellpad apparatus locations of the wellpad expansion module and connected to the wellpad apparatus via highlines. The wellhead spacing is shown as distance D1, which is typically set by the owner and is typically 5 meters or greater, and which is also approximately the spacing between wellpad apparatus locations. When the wellpad expansion module is configured to connect to two wells, the two rightmost wellpad apparatus locations can be omitted and the length of the expansion module can be represented by D2. When the wellpad expansion module is configured to connect to four wells, the length of the wellpad expansion module can be represented by D3. The width of the wellpad expansion module is represented by D4, which in one embodiment may be about 14 feet, six inches.

Ladder and Handrails (not shown) can be located on the opposite side of the wellpad expansion module from the group and test headers 6.

Embodiments of the present invention provide for a wellpad apparatus (core layout assembly) for use in a gas wellpad expansion module. The wellpad apparatus may be partially or fully manufactured (prefabricated), prior to well site delivery, as a generic (e.g. standardized), adjustable modular assembly. As such, the wellpad apparatus can be placed at an appropriate location at the wellsite, connected to an existing gas well (e.g. via a highline) and existing output piping, and subsequently operated without further intensive assembly, although some adjustment may be performed. For example, the wellpad apparatus can be placed on an open pad of a wellpad expansion module, either prior to or following delivery of the wellpad expansion module to the wellsite. The wellpad apparatus includes an input connection for joining the apparatus to a gas wellhead to receive pressurized gas therefrom. The wellpad apparatus further includes one or more gas handling components fluidically coupled to the input connection. The wellpad apparatus further includes a heated, standalone enclosure comprising at least one of the one or more gas handling components. In some embodiments, the heated enclosure is sized and configured to contain only these gas handling components. In some embodiments, the heated enclosure comprises a heater that operates using gas received directly from the gas wellhead, or alternatively gas received from a storage tank which may hold gas received from the gas wellhead. The wellpad apparatus further includes an output connection fluidically coupled to the one or more components, the output connection for joining the wellpad apparatus to output piping.

The one or more components of the wellpad apparatus may include some or all of: a group header; a test header; an emergency shutdown valve; a gas meter; a pair of blast tees for coupling to sand separator equipment; and a choke valve. In some embodiments, the wellpad apparatus may include other components as required, such as a chemical tank and chemical injection system. In some cases, the wellpad apparatus may be configurable during manufacture or in the field to include one or more desired optional components.

In various embodiments, the wellpad apparatus is configured to receive pressurized gas solely from a single gas wellhead, and the wellpad apparatus is located adjacent to the gas wellhead. As such, the wellpad apparatus handles gas from a single wellhead, rather than multiple wellheads, which allows the wellpad apparatus to be potentially located as close as practicable to the wellhead. That is, the wellpad apparatus handles gas on a per-well basis, with a one-to-one correspondence between gas handling apparatuses and wellheads. Furthermore, the wellpad apparatus may be located at and accessible from ground level. Multiple, substantially identical wellpad apparatuses can be provided as part of an expansion module.

FIG. 3A illustrates a wellpad apparatus (core-layout assembly) in accordance with an embodiment of the present invention. FIG. 3B schematically illustrates various components of the wellpad apparatus of FIG. 3A. FIG. 3B also schematically illustrates the blast tees' fabrication designs of strategically placed pup pieces, spectacle blinds and spacer bleed rings, which would allow ready rearrangement of these tees for sand separation or normal operation modes. The wellpad apparatus may be provided as a standalone prefabricated apparatus or as part of a wellpad expansion module.

Having reference now to FIGS. 3A and 3B, the wellpad apparatus includes a heated enclosure 1 which may include metering components and/or other components of the wellpad apparatus which require heating. The heated enclosure 1 may be configured to maintain an interior temperature within a predetermined range, e.g. using fans, heaters, or a combination thereof. The heated enclosure 1 may include monitoring elements for detecting faults such as gas buildup or out-of-temperature range conditions. Gas piping downstream of the choke valve 5 and flanged rotatable connector 15 can enter the heated enclosure 1 through a hole in one sidewall and exit the heated enclosure 1 through a hole in the other sidewall for connection to the group and test header connections 3 (and associated valves, where applicable). The gas piping can connect to components internal to the heated enclosure 1, such as a gas meter M. The gas meter is placed, for example, at a height of about 1.2 meters above an operating access level. Other components such as chemical pumps and calibration equipment can be placed, for example, at a height of between 1.2 meters and 1.8 meters. In various embodiments, the heated enclosure, not being classified as an occupied building, may in some embodiments be installed without requiring monitoring. The heated enclosure, due to its limited size, may only require a low-cost efficient catadyne type heater that uses available produced gas.

The wellpad apparatus further includes the highline connection pipe 2 between a wellhead and a wellpad apparatus of the expansion module. The highline connection pipe 2 includes a pipe and a connector such as a flanged connector. The wellpad apparatus further includes the group and test header connections 3. The group header connection couples gas output to a common bulk gas pipe, while the test header connection couples gas output to one of one or more test pipes. Shut-off valves may be provided at the group and test header connections 3, as well as connectors such as flanged connectors. In various embodiments, no riser connection from the wellhead to a pipe way is required, because the wellhead is connected directly to the core layout assembly, and the corresponding pipe way is omitted.

In the presently illustrated embodiment, the wellpad apparatus further includes the ESD valve 4. The ESD valve may be connected directly to the output of the highline connection pipe 2. The gas flow channel through the ESD valve 4 may be aligned with the highline connection pipe 2. The ESD valve can be controllably switched between a valve open configuration, which allows the flow of gas, and a valve closed configuration, which shuts off the flow of gas, e.g. in an emergency situation. The ESD valve may be verified as part of factory acceptance testing, rather than in the field. Placement of the ESD valve on the apparatus also mitigates the need for access stairs or platform at the wellhead itself.

The compact core layout design of the wellpad apparatus can be aligned with the wellhead such that a straight piping run connects the wellpad apparatus to the wellhead, which may constitute an efficient and low-cost configuration. This piping run is commonly called the highline, and may be located for example at approximately 8'-6" above grade. The ESD valve 4 is typically closed-coupled to the wellhead, because it is generally considered not desirable to have any turns or components between wellhead and the ESD valve. The wellpad apparatus (core layout assembly) may thus be located and configured such that the highline is substantially straight. This allows the ESD valve 4 to be positioned so that it is closed-coupled to one of the blast tees 14, while also meeting regulatory requirements, if applicable. Such a configuration may facilitate accessibility to key operating auxiliary valves of the ESD valve from the same operating level as the core layout assembly, and thus can mitigate the need for a traditional separate access platform for the ESD valve at the wellhead.

It is noted that the ESD valve 4 may be omitted from the wellpad apparatus (core-layout assembly) in some embodiments. Instead, an ESD valve can be located at the wellhead. In this case, the ESD valve 4 can be replaced with a section of pipe, or the highline connection pipe 2 can be directly coupled to the first blast tee 14.

It is noted that, in various embodiments of the present invention, the components of the core layout assembly are substantially all closed-coupled and, where possible, the components may be coupled fitting-to-fitting. It is noted that this type of layout is generally not done, because of the difficulty in maintaining sufficient piping layout flexibility while mitigating overstressing branch and directional-change components. In general, lack of piping layout flexibility may cause the piping and equipment connections to be over-stressed from simple gravity and thermal expansion loads. The lack of piping layout flexibility may also amplify dynamic loads from gas transient operational modes or from emergency shut off dynamic loads (i.e. due to operation of the ESD valve). In contrast, embodiments of the present invention, while closed-coupled in design, also have sufficient flexibility in the inherent design to mitigate sustained gravity and thermal connection stresses. The relatively simple design and layout also facilitates full functionality of the wellpad apparatus and robustness to the potential problems mentioned above. However, it is noted that dynamic loads due to emergency shutdowns are unpredictable and are difficult to fully quantify. Therefore, embodiments of the present invention also provide for a piping (ESD valve) anchor which may be located at the position of the ESD valve 4, where the emergency dynamic loads are anticipated to be the largest (provided that the ESD valve is included in the apparatus and/or well expansion module comprising same). Alternatively, when the ESD valve is located on the wellhead, the issue of dynamic loads is expected to be less problematic. The anchor mitigates potential damage due to thermal and dynamic stresses. The anchor may be a directional anchor.

The apparatus further includes the choke valve 5. The choke valve is operable to controllably restrict gas flow, and includes a horizontal input port and a vertical output port. A movable plunger (e.g. movable using a control wheel) is used to set the amount of flow restriction at a bend in the fluid flow channel internal to the choke valve. Appropriate choke valves incorporating a 90 degree bend can be used as would be readily understood by a worker skilled in the art. In the illustrated configuration, the 90 degree bend redirects the gas flow from a horizontal orientation to a downward vertical orientation. This also has the effect of transitioning the gas flow from an upper level toward a lower level. The lower level can include the gas metering components, group and test headers and/or group and test header connections The lower level may be more accessible to a worker than the upper level.

The choke valve 5 is a device which typically exhibits a naturally angled shape and flow pattern. This shape typically presents a layout challenge which is often solved, in other systems, by using extensive piping materials and supports to locate it in an operable position. In contrast, in embodiments of the present invention, with the described locations of the heated enclosure 1 and blast tees 14 set, the choke valve 5 can be placed between them. This position may also result in the choke valve 5 being located at a desirable access height. The choke valve 5 is closed-coupled to a blast tee 14, with limited lengths of and pup pieces (short piping) and an elbow to connect to the heated enclosure 1 (and meter M thereof).

The apparatus further includes two blast tees 14 which are coupled between the ESD valve 4 and the choke valve 5. The blast tees 14 are T-shaped and include three fluidically coupled openings. A first two ends (aligned ends) are aligned and coupled by a first straight section of pipe; a third end (the non-aligned end) is oriented perpendicularly to the first two ends and coupled by another straight section of pipe extending perpendicularly from the first straight section of pipe. One aligned end of a first blast tee 14 is coupled to the ESD valve 4. The non-aligned end of the first blast tee 14 may be coupled to an aligned end of a second blast tee 14. A spectacle blind 18 is coupled between the first and second blast tees at this location. The spectacle blind can operate for example as a spacer (allowing fluid flow therethrough), or a blind paddle (inhibiting fluid flow), as would be readily understood by a worker skilled in the art. The non-aligned end of the second blast tee 14 is coupled to the choke valve 5. The other aligned ends of the first and second blast tees 14 can be coupled, as needed, to a sand separator unit SS, or other auxiliary gas processing equipment.

The two blast tees 14 are oriented horizontally, such that gas is directed horizontally through same, and within a plane which includes the highline and/or the highline connection pipe 2.

In some embodiments, the first blast tee 14 may be closed-coupled to the ESD valve 4 via a first pup piece, e.g. having length d1, the second blast tee may be closed-coupled to the choke valve 5 via a second pup piece, e.g. also having length d1, and the first and second blast tees may be closed-coupled via a third pup piece, e.g. having length d2. Each pup piece comprises a length of pipe and at least one flanged connector. Another pup piece, e.g. having length d1, can be coupled to the aligned end of the second blast tee 14 which is used for coupling to the sand separator unit SS. Further, a spacer (comprising a section of pipe) having length d3=d2−d1 can be coupled to this pup piece. Lengths d1 and d2 of the pup pieces can be set in response to length d3 of the spacer.

In various embodiments, length d1 is at least equal to a minimum length which is required to facilitate bolt removal, e.g. in relation to the removal of bolts coupling the blast tee 14 to the ESD valve 4. Further, length d2 may be constrained to be greater than length d1. Lengths d1, d2 and d3 can be customized for a given installation. In some embodiments, if d1 or d2 is reduced to zero, the corresponding pipe can be omitted and components can be directly coupled (fitting to fitting coupling), provided that structural integrity can be maintained under operating conditions. Length d3 can refer to the dimension of a bleed ring.

In some embodiments, the blast tees may be omitted, for example by replacing them with a section of pipe, such as a U-shaped horizontal pipe, coupling the ESD valve 4 to the choke valve 5.

The blast tees 14 may be closed-coupled and set-up with appropriately designed spacers and/or pup pieces to allow reconfiguration of flow to a sand separation unit SS. These sand separation units are typically used in the set-up period of a well, and may be removed after set-up. In other implementations, valving, pipe runs, supporting and operational access structures are custom designed for specific types of sand separators. In contrast, the blast tee 14 configuration illustrated in FIGS. 3A and 3B can facilitate connection to a variety of sand separator equipment. Because of the compactness and configuration of the core layout assembly, substantial plot space is opened up to allow the usage of a variety of types of sand separator, thereby improving operational flexibility.

In various embodiments, the Blast tees are T-shaped connectors, used in place of elbow connectors in erosive service, where the blast tee provides a dead leg that softens the erosive service flow. Erosive sand is typically produced for durations after start-up, where piping turns from wellhead to sand separator location will require blast tees. Various embodiments of the present invention include only two blast tees per apparatus. The blast tees are considered maintenance access items that are reachable from a module operating level and freely accessible by equipment. In one embodiment, a (e.g. 6 foot) ladder (rather than stairs) may be provided for accessing and bolting/unbolting the blast tees.

The output of the choke valve 5 is connected to components of the heated enclosure 1 via a section of pipe having a 90 degree bend, with a vertical input end connecting to the choke valve and a horizontal output end. In some embodiments, a flanged rotatable connector 15 (e.g. a high-integrity flanged rotatable connector) is provided at the output of the choke valve 5 or integrated into the section of pipe between the choke valve and the heated enclosure. The flanged rotatable connector 15 comprises two mating flanges which can be relatively rotated so as to allow for relative rotation of components on an input side of the connector and components on an output side of the connector. The relative rotation includes rotation in a horizontal plane. As such, with the heated enclosure 1 held in place, the choke valve 5 and all components of the apparatus which are upstream of the choke valve 5 can be rotated about a vertical axis aligned with the choke valve 5 and in the rotation directions 20.

The co-location of the flanged rotatable connector 15 with the pup piece between the choke valve 5 and the heated enclosure 1 and/or meter M facilitates adjustment of the apparatus to compensate for angular misalignment between the wellhead and the core layout assembly. The location and orientation of the choke valve 5, with its inherent angled shape, facilitates this placement and operation of the flanged rotatable connector 15. While construction procedures and practices are normally put in place to inhibit misalignment with the highline, it is possible that misalignment can still occur, and such misalignment can be addressed using the adjustability of embodiments of the present invention. Further, the adjustability reduces the need to tightly adhere to precision construction procedures. In other embodiments, these adjustability features may be omitted.

In various embodiments, the apparatus can be adjusted to mate with a given highline as follows. The flanged rotatable connector 15 can be rotatably adjusted, and/or the lengths of one or more of the pup pieces coupled to the blast tees 14 can be adjusted in length. Adjusting the length of a pup piece can comprise replacing the pup piece with one of a different length, or cutting or machining a pup piece to a desired length. The wellpad apparatus can then be equipped with a combination of pup piece lengths d1 and d2, and an amount of rotation of the flanged rotatable connector 15, which provides for close-fitting mating engagement of the apparatus with a highline, which may be fixed in place. Adjustment of the pup piece lengths can result in the illustrated lateral adjustment 21. Thus, in various cases, no additional piping, bending, etc. needs to be performed to the highline. Further, in various cases, adjustment to fit the highline may be performed via the use of the high integrity rotatable flanged connection (item 15 in FIG. 3B), while respecting connectability of the apparatus to the sand separator SS via the blast tees 14. As such, the apparatus may include one or more adjustable components for adjusting one or both of the rotation orientation of the highline connection and the horizontal location of the highline connection.

In view of the above, embodiments of the invention provide for a pre-fabricated wellpad apparatus or corresponding wellpad expansion module which is adjustable to align to out-of-spec locations and/or orientations of wellhead highline connections. This adjustability is facilitated by the particular combination and configuration of piping and gas handling component layout as described herein, along with the strategic technical placement of adjustment provisions such as rotatable connectors and length-adjustable pup pieces.

Accordingly, embodiments of the present invention provide for a wellpad apparatus for use in a gas wellpad expansion module. The wellpad apparatus is manufactured (prefabricated) prior to well site delivery as a generic or standardized, adjustable modular assembly. The wellpad apparatus includes an input connection for joining the apparatus to a gas wellhead to receive pressurized gas therefrom. The input connection can include the highline connection pipe 2. The wellpad apparatus further includes an emergency shutdown valve 4 aligned with the input connection and having a channel oriented in a first horizontal direction. The wellpad apparatus further includes a first horizontally oriented blast tee 14 having a horizontal input arm aligned with the channel of the emergency shutdown valve and having a horizontal output arm oriented in a second horizontal direction that is perpendicular to the first horizontal direction. The wellpad apparatus further includes a second horizontally oriented blast tee 14 having a second horizontal input arm aligned with the output arm of the first blast tee and having a second horizontal output arm oriented horizontally and opposite to the first horizontal direction. The wellpad apparatus further includes a choke valve 5 having a horizontal input pipe coupled to the second horizontal output arm of the second blast tee, and a first vertical piping coupled to an output of the choke valve. The wellpad apparatus further includes a coupling section having a vertical input connected to the output of the choke valve and a horizontal output oriented horizontally and opposite to the first horizontal direction. The coupling section can include the flanged rotatable connection 15. The wellpad apparatus further includes a heated enclosure 1, for example including a metering component, the heated enclosure 1 and its metering component connected in-line with the horizontal output of the coupling section. The wellpad apparatus further includes an output connection fluidically coupled to the metering component, the output connection for joining the wellpad apparatus to output piping. The output connection can include the group and test header connections 3.

In various embodiments, some or all of the above-described components are closely fluidically coupled to each other. Close coupling refers to the fact that the output of a first component is coupled to the input of the next adjacent component either by directly coupling the fitting of the first component's output to the fitting of the next component's input, or by using only a short section of piping between the fitting of the first component's output to the fitting of the next component's input. The piping can be short e.g. relative to the length of the components, and can be minimal in the sense that the piping is no longer than what is required to properly fit the components together. This close coupling provides for a compact, cost-effective and also efficient structure. In some cases, close coupling may comprise direct, fitting-to-fitting coupling, in which intermediate spacers or piping is omitted between two functional components such as valves and blast tees.

However, close coupling of components can lead to issues such as equipment vibrational issues. This may arise for example due to a water hammer effect, particularly when the gas being handled is a wet gas, and further when multiple wellpad apparatuses are provided on the same structural skid as part of a wellpad expansion module. To mitigate this, the anchor is designed appropriately with inline gaps and lateral movements, working in combination with the overall flexible arrangement of fitting-to-fitting piping and closed-coupled equipment layout.

Embodiments of the present invention provide for an arrangement of closed-coupled (e.g. fitting-to-fitting coupled) components which leverage the inherent shape and configuration of the components to provide for an overall component layout which achieves compactness and limited piping runs and turns. For example, bends introduced by components such as blast tees and choke valves are used to facilitate compactness of the apparatus, by placing such bends so that the gas fluid path turns in on itself and is retained within a limited volume. Among other things, this allows for the footprint of the wellpad apparatus to be limited, and the amount of structural supports to also be limited.

Figure 4:
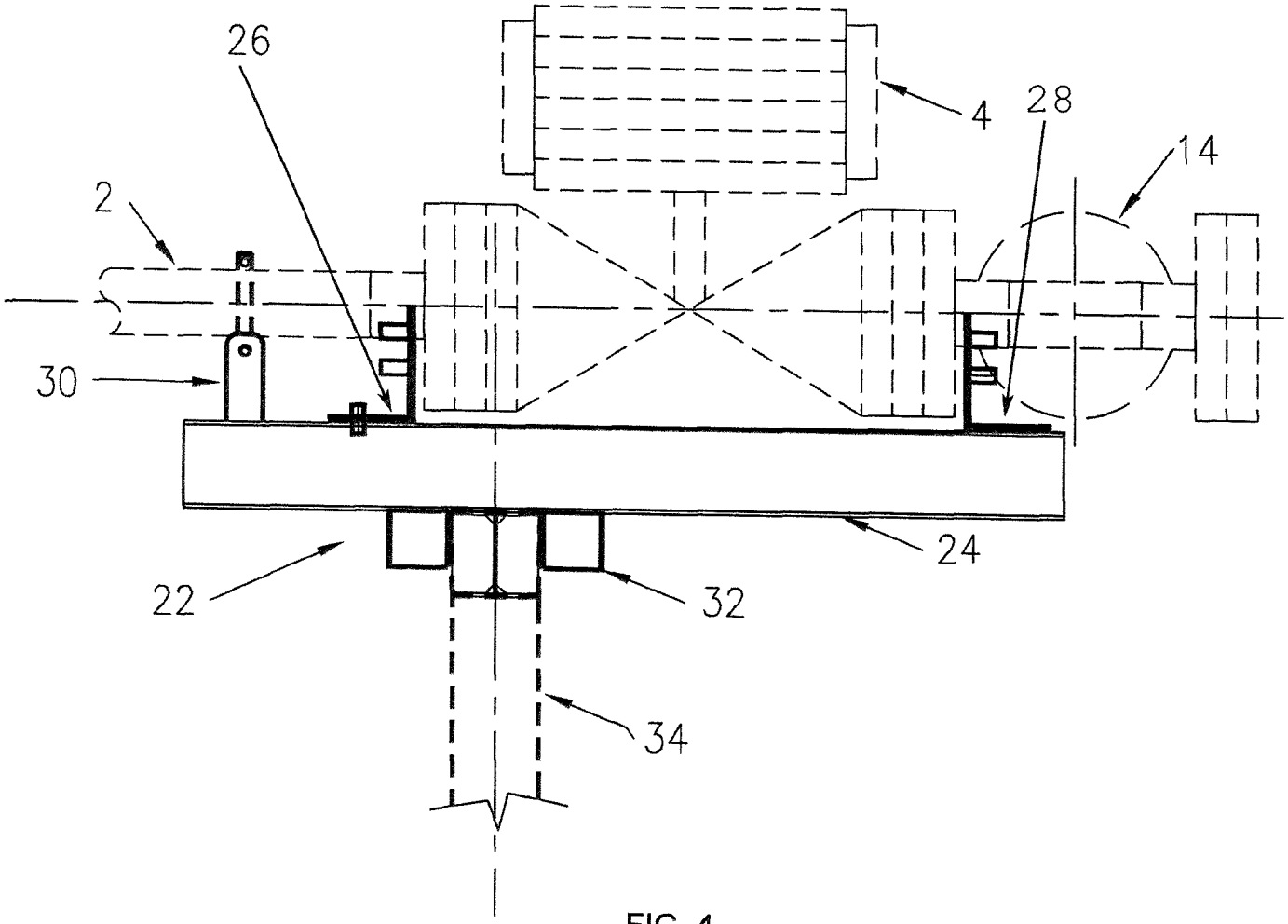
FIG. 4 illustrates an anchor for mitigating dynamic loads, according to an embodiment of the present invention.

FIG. 4 illustrates the overall design of the Cantilevered Directional Anchor assembly (CDA) 22, configured to mitigate stresses due to dynamic loads in a wellpad apparatus and/or a wellpad expansion module comprising same, in accordance with an embodiment of the present invention. The anchor assembly 22 is configured to transfer both the support and anchor load points to a support column 34. This arrangement can use existing module steel for bearing the loads of the ESD anchor and associated components, while freeing up plot space for unrestricted selection of sand separator type or hook-up configuration preferences. The Cantilevered Directional Anchor assembly 22 is located under the ESD valve 4 and is configured to support same as well as dampen or mitigate dynamic mechanical stresses imposed on the ESD valve 4 due to the emergency interruption of gas flowing through the apparatus. The anchor beam 24 of the anchor assembly 22 extends from the highline connection pipe 2 (upstream of ESD) to the blast tee 14 (downstream of ESD), and is structurally integrated (welded or bolted) with a fixed L-bracket 26, the fixed L-bracket 26, the clevis 30, and the directional anchor stops (typical two pieces of T-sections) 32. The integrated structure of items 24, 26, 30 and 32, together with the sliding L-bracket 28, forms the overall Cantilevered Directional Anchor assembly (CDA) 22.

On the upstream side of the CDA (i.e. proximate to the highline connection pipe 2), a moment connection is created to provide overall structural integrity and cantilever capability. The fixed L-bracket 26 rigidly connects the upstream ESD valve flange bolts to the anchor beam 24, while the clevis 30 is connected to the highline connection pipe, for example via a pin. As such, the anchor beam 24 functions as a rigid member for anchoring the ESD and other process components connected immediately to the ESD. On the downstream side of the CDA, a sliding L-bracket 28 may be used for dead load support of the ESD 4 and blast tee 14. The pinned connection of the clevis 30 and the sliding aspect of bracket 28 allow thermal flexibility, while facilitating serviceability.

The anchor beam 24 (typically a steel W-section), extends underneath the ESD valve 4, from the highline connection pipe 2 to the blast tee 14. In some embodiments, the CDA is in the range of 1000 mm to 1400 mm long, and will weigh (together with ESD 4 and connecting components) in the range of 550 to 800 kilograms. The large and heavy CDA unit can be supported and anchored close to the upstream flange of the ESD 4, proximate to the position of the support column 34. The actual directional anchor stops 32 may be a pair of steel T-sections. These T-sections are rigidly attached to anchor beam 24, yet they are separated from the rigid support column 34 by gaps (e.g. 3 mm gaps). The result is anchoring of movements in the direction of process flow or potential dynamic forces, while allowing flexibility horizontally and perpendicular to process flow. The support column 34 may be centered on the junction between the highline connection pipe 2 and the ESD valve 4. The support column 34 is fully anchored to the boundary structural steel of the wellpad module. The wellpad apparatus or module structure is attached to piles and anchored to ground.

It should be appreciated that standard types of directional anchors can only be attached to bare piping, not instrumented valves like the ESD valve 4 or fittings of certain configurations such as the blast tee 14. Hence, conventional directional anchors are inappropriate for use unless the core layout assembly was changed to a less effective design and additional support columns be added. It is also noteworthy that the CDA illustrated in FIG. 4 can facilitate use of a large and heavy assembly of the ESD 4 and blast tee 14, cantilevered from the support column 34. As such, the wellpad apparatus and/or the wellpad expansion module can be kept within minimum shipping dimensions and operating access can be provided between the wellpad apparatus and sand separators.

In various embodiments of the present invention, substantially all operational access is within 1.2 m to 1.4 m above the wellpad expansion module's operating platform level, with some low frequency operating points at 1.8 m, which are well within industry best practice and OHSA guidelines. Although scheduled maintenance access does not have permanent platform access, maintenance preparation point like vents and drains can be accessed from operating level with a 2-step ladder or from ground with a standard 8' ladder. Unbolting of ESD 4 or blast tees 14 can be accessed with 8' ladder from ground. Sufficient equipment access space is inherently provided by embodiments of the present invention's design to facilitate maintenance equipment access (e.g. picker or basket machinery).

Although the present invention has been described with reference to specific features and embodiments thereof, it is evident that various modifications and combinations can be made thereto without departing from the invention. The specification and drawings are, accordingly, to be regarded simply as an illustration of the invention as defined by the appended claims, and are contemplated to cover any and all modifications, variations, combinations or equivalents that fall within the scope of the present invention.

LEGEND OF TERMS APPEARING IN FIGURES

WH1: Wellhead #1
SS1: Sand Separator #1
D1: Wellhead Spacing
D2: Module length (two well basis)
D3: Module Length (four well basis)
D4: Module Width (within 14'-6")
1: Heated Metering Enclosure
2: Highline connection pipe to wellhead
3: Group and Test Header Connections
4: ESD Valve (anchored zone)
5: Choke Valve (returned flow to Meter zone)
6: Group and Test Headers
7: E&I and Pneumatics Tray and Conduits Zone
8: Junction Box (JB)
9: Structural Steel Skid-Base Boundary
10: Menthol Tank and utility Zone
11: Operating Access Level
12: Optional Equipment level
14: Blast Tees for sand separator connections.
15: High Integrity Flanged Rotatable connection
18: Spectacle Blind
20: Rotational adjustment of highline as needed.
21: Lateral Adjustments of highline by using d1, d2, d3 as needed.
d1: Pup Piece, minimum length for ESD bolt removal.
d2: Pup piece. d2>d1. d2 length TBC during design.
d3: Spacer bleed ring length. d3=d2−d1.
22: Cantilevered Directional Anchor assembly (CDA)
24: Anchor beam (W-section)
26: Fixed L-Bracket
28: Sliding L-Bracket
30: Clevis
32: Directional Anchor Stops
34: Rigid Support Column The embodiments of the invention in which an exclusive property or privilege is claimed are defined as follows:

1. A wellpad apparatus for use in a gas wellpad expansion, the apparatus manufactured as a generic, adjustable modular assembly and comprising:

an input connection for joining the apparatus to a gas wellhead to receive pressurized gas therefrom;

an emergency shutdown valve aligned with the input connection and having a channel oriented in a first horizontal direction;

a first horizontally oriented blast tee having a horizontal input arm aligned with the channel of the emergency shutdown valve and having a horizontal output arm oriented in a second horizontal direction that is perpendicular to the first horizontal direction;

a second horizontally oriented blast tee having a second horizontal input arm aligned with the output arm of the first blast tee and having a second horizontal output arm oriented horizontally and opposite to the first horizontal direction;

a choke valve having a horizontal input pipe coupled to the second horizontal output arm of the second blast tee, the choke valve further having a first vertical piping coupled to an output of the choke valve;

a coupling section having a vertical input connected to the output of the choke valve and a horizontal output oriented horizontally and opposite to the first horizontal direction;

a metering component in a heated enclosure, the metering section connected in line with the horizontal output of the coupling section; and an output connection fluidically coupled to the metering component, the output connection for joining the wellpad apparatus to output piping.

2. The apparatus of claim 1, wherein at least two of: the input connection, the emergency shutdown valve, the first blast tee, the second blast tee, the choke valve, the coupling section, the metering component and the output connection are closed-coupled or coupled fitting-to-fitting.

3. The apparatus of claim 1, wherein the input connection, the emergency shutdown valve, the first blast tee, the second blast tee, the choke valve, the coupling section, the metering component and the output connection are closed-coupled or coupled fitting-to-fitting.

* * * * *